United States Patent [19]

Karpanty

[11] Patent Number: 4,464,810

[45] Date of Patent: Aug. 14, 1984

[54] SCRUBBING MACHINE WITH LIQUID RECIRCULATION

[75] Inventor: David J. Karpanty, Toledo, Ohio

[73] Assignee: The Scott & Fetzer Company, Lakewood, Ohio

[21] Appl. No.: 401,069

[22] Filed: Jul. 23, 1982

[51] Int. Cl.[3] ..... A47L 11/202

[52] U.S. Cl. ..... 15/320; 15/353; 210/512.1

[58] Field of Search ..... 15/320, 353, 302, 321; 210/512.1

[56] References Cited

U.S. PATENT DOCUMENTS

| | | | |
|---|---|---|---|
| 2,397,718 | 4/1946 | Albertson | 210/512.1 X |
| 3,663,985 | 5/1972 | Burgoon | 15/353 |
| 4,142,270 | 3/1979 | Nauta | 15/353 |
| 4,200,951 | 5/1980 | Burgoon et al. | 15/353 X |
| 4,333,202 | 6/1982 | Block | 15/320 |
| 4,348,783 | 9/1982 | Swanson et al. | 15/320 |
| 4,377,017 | 3/1983 | Herpers et al. | 15/320 |

*Primary Examiner*—Chris K. Moore

*Attorney, Agent, or Firm*—Allen D. Gutchess, Jr.

[57] ABSTRACT

A scrubbing machine is provided in which cleaning solution, usually mostly water, is cleaned and recirculated. The machine includes a frame supported on wheels with at least one scrubbing brush supported by the frame. A squeegee and vacuum hose are located behind the scrubbing brush for removing water from the surface which was supplied to the surface near the scrubbing brush. A recovery tank and a supply tank are supported on the frame with the vacuum hose communicating with the recovery tank. An exhaust blower also communicates with the recovery tank and draws air and water through the exhaust hose and into the recovery tank, exhausting air therefrom. The recovery tank has baffles which form a tortuous path to separate the air and dirty water as they travel through the recovery tank in the path from one end to the other. The recovery tank is separated into two chambers with most water and dirt received in the first chamber in which the dirt settles to the bottom, and cleaner water flows over an upper edge of a separating wall into the second chamber. The water in the second chamber can then be pumped to a dirt separator located in the first chamber and from there back to the supply tank from which water and a detergent, if used, are supplied to the vicinity of the scrubbing brush.

17 Claims, 5 Drawing Figures

SCRUBBING MACHINE WITH LIQUID RECIRCULATION

This invention relates to a machine for scrubbing surfaces with a cleaning solution which can be recirculated and reused.

Heretofore, scrubbing machines commonly have had a plurality of disc-type scrubbing brushes located under the machine in overlapping relationship. Liquid or solution, in the form of water or water and detergent, are supplied from a solution or supply tank to the disc brushes. A squeegee assembly is located behind these brushes to gather solution and dirt which are picked up by an exhaust hose and deposited in a recovery tank. When the solution is emptied from the supply tank it is refilled and the dirty solution is drained from the recovery tank.

The present invention provides a floor cleaning machine which provides a scrubbing action for a surface and can also provide a sweeping action, if desired. The machine includes disc brushes, a squeegee assembly, and recovery and supply tanks, preferably located in side-by-side relationship at a forward portion of the machine. Solution and dirt are drawn into the recovery tank through an exhaust hose from the squeegee assembly and the recovery tank has a separating wall forming the tank into two chambers. A plurality of baffles and passages in this tank form a tortuous path for the solution and dirt which enables much of the dirt and some solution to be deposited in the first chamber with the remaining solution and dirt deposited in the second chamber as the air is exhausted from the recovery tank by an exhaust blower. Cleaner solution from the second chamber can then be supplied back to the supply tank for reuse, again being supplied to the disc brushes. Preferably, a dirt separator is also located in the recovery tank, in the first chamber. The cleaner solution from the second chamber is then pumped through the separator where much of the liquid-borne dirt is removed and the cleaned water then supplied to the supply tank.

The floor cleaning machine can also be used in the usual manner in which supply tank is filled with clean solution, most of which is subsequently recovered in the recovery tank and from which it is subsequently drained. With this design, the floor cleaning machine can be used in the conventional manner for extremely dirty surfaces and then the floor can be cleaned again with recirculated solution.

It is, therefore, a principal object of the invention to provide a floor cleaning machine with a solution recirculating system, which machine can also be used in the conventional manner.

Another object of the invention is to provide a floor cleaning machine having a supply tank and a recovery tank, the latter having two chambers and providing a tortuous path for solution and dirt entering the tank from an exhaust hose communicating with a squeegee assembly.

Yet another object of the invention is to provide a floor cleaning machine having a recovery tank with a centrifugal separator therein which separates solution and dirt prior to supplying the solution to a supply tank for reuse.

Many other objects and advantages of the invention will be apparent from the following detailed description of a preferred embodiment thereof, reference being made to the accompanying drawings, in which.

Figure 1:
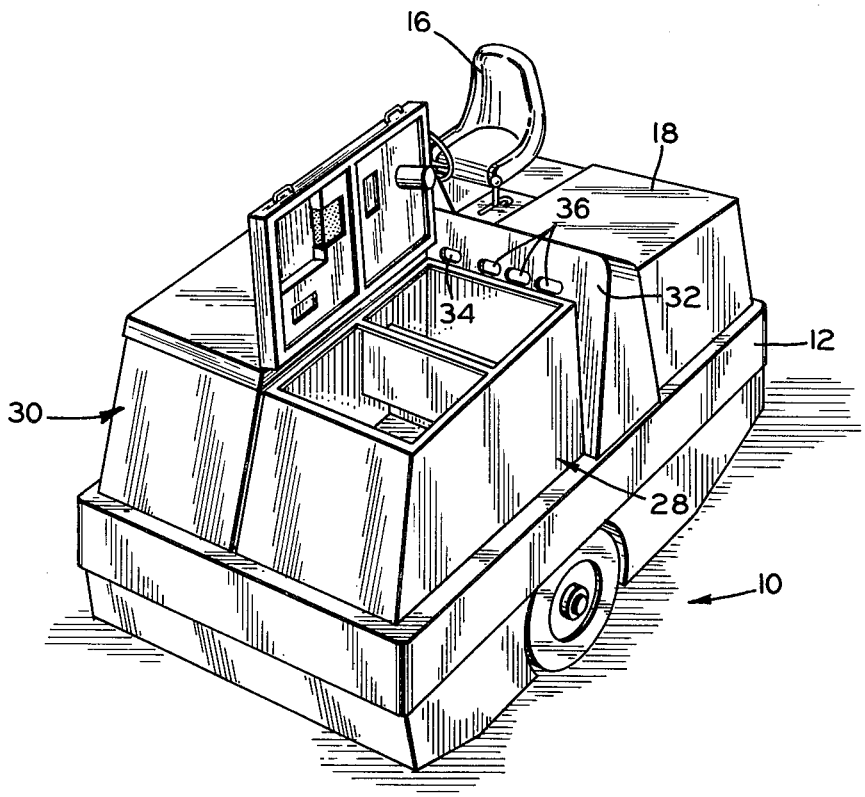
FIG. 1 is a view in perspective of a scrubbing machine embodying the invention, with a lid of a recovery tank raised.
Figure 2:
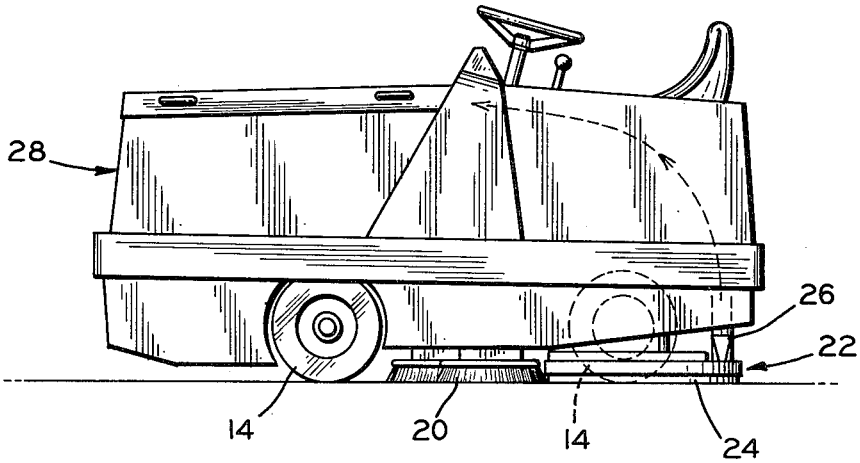
FIG. 2 is a somewhat schematic side view in elevation of the machine of FIG. 1.

Referring to FIGS. 1 and 2, a scrubbing machine embodying the invention is indicated at 10. The machine can also be used as a combination scrubbing and sweeping machine by embodying a drum broom under a forward portion of the machine to sweep debris into a forward hopper as is shown in my copending U.S. patent application Ser. No. 235,436, now U.S. Pat. No. 4,363,152, issued 12/14/82, and assigned to the same assignee, by way of example. The machine 10 includes a main frame 12 supported on wheels 14 with a driver's seat 16 and an engine compartment 18 at the rear of the machine. Disc-type scrubbing brushes 20 are supported under an intermediate portion of the machine and are preferably rotated by individual hydraulic motors. A squeegee assembly 22 is supported below a rear portion of the machine and has squeegee blades 24 to gather and collect solution deposited upon the surface to be cleaned at or near the scrubbing brushes 20. The solution and dirt, along with air, are picked up through a vacuum hose or line 26 and delivered to recovery tank 28. The solution is supplied to the surface in front of or through openings in the scrubbing brushes 20 from a supply or solution tank 30 located in side-by-side relationship with the recovery tank 28 toward the forward portion of the machine.

In the usual operation of a scrubbing machine, clean water is placed in the supply tank 30, detergent is usually added, and most of the resulting solution which is deposited upon the surface is subsequently recovered in the recovery tank 28 and is subsequently drained or dumped.

In the new scrubbing machine 10, the dirty solution recovered in the recovery tank 28 is cleaned and supplied back to the supply tank 30 for reuse. This saves substantial amounts of water and detergent requirements, and reduces labor requirements significantly since conventional machines must be dumped, cleaned, and refilled after each cleaning cycle.

The machine 10 has an upright panel 32 behind the recovery tank 28 with an inlet opening 34 with which the exhaust line 26 communicates, and three exhaust openings 36. The recovery tank 28 has a lid 38 in which is formed a longitudinally-extending inlet passage 40 having an inlet opening 42 aligned with the inlet opening 34 when the lid is closed, and having an outlet 44 at the opposite end.

The recovery tank 28 has a dividing wall 46 extending transversely thereacross and dividing the tank into a first chamber 48 and a second chamber 50. A baffle 52 is parallel to the dividing wall 46 and extends downwardly into the first chamber 48, below the normal level of liquid therein. This baffle also retains floating debris which does not settle in the tank.

Air, solution, and dirt which are drawn into the passage 40 through the inlet opening 42 proceed to the outlet opening 44 and into the space above the liquid in the first chamber 48 of the recovery tank. From here, the air, solution, and remaining dirt are drawn upwardly through a perforate L-shaped filter 54 and into a lid chamber 56 above the baffle 52. The sharp change in direction of the air, solution, and dirt traveling from the outlet opening 44 to the perforate filter 54, along with the reduced velocity as the large space above the chamber 48 is entered, causes most of the solution and dirt to be deposited in the chamber 48. The filter 54 primarily is used to apply surface tension to any head of foam to break it up. It also filters any large, light floating air-borne debris or debris laying on the foam.

The air, solution, and remaining dirt then travel from the chamber 56 through an outlet opening 58 to the space above the liquid in the chamber 48 on the opposite side of the baffle 52. The air and solution then extend to the space above the liquid in the second chamber 50 and out an exhaust filter 60 where any remaining solution is separated from the air as the air changes direction and exhausts through the perforate side of the filter on the back thereof relative to the air flow direction. The air then enters an exhaust chamber 62 in the lid and exits through three exhaust openings 64 which are aligned with the three exhaust openings 36 in the upright panel 32. The air flows through an exhaust blower 66 which dissipates it into the engine compartment 18.

With the undulating path of travel of the air and solution, along with air-borne dirt and solution-borne dirt, most of the dirt and dirty solution are separated in the space above the first chamber and are deposited in the first chamber 48. Remaining cleaner solution is separated from the air into the chamber 50.

Figure 3:
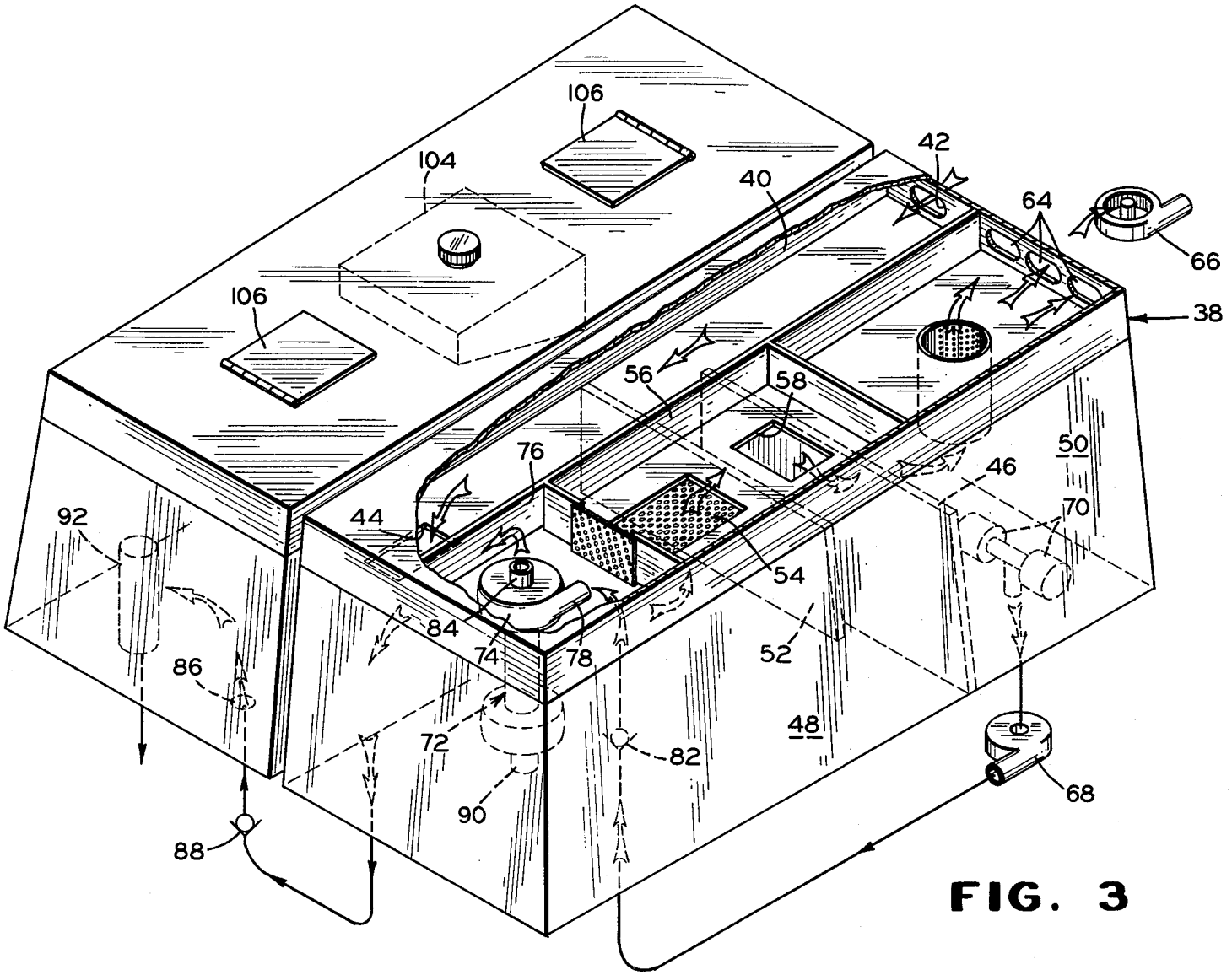
FIG. 3 is a somewhat schematic view in perspective of a solution or supply tank and the recovery tank, with parts broken away in the lid of the recovery tank.
Figure 4:
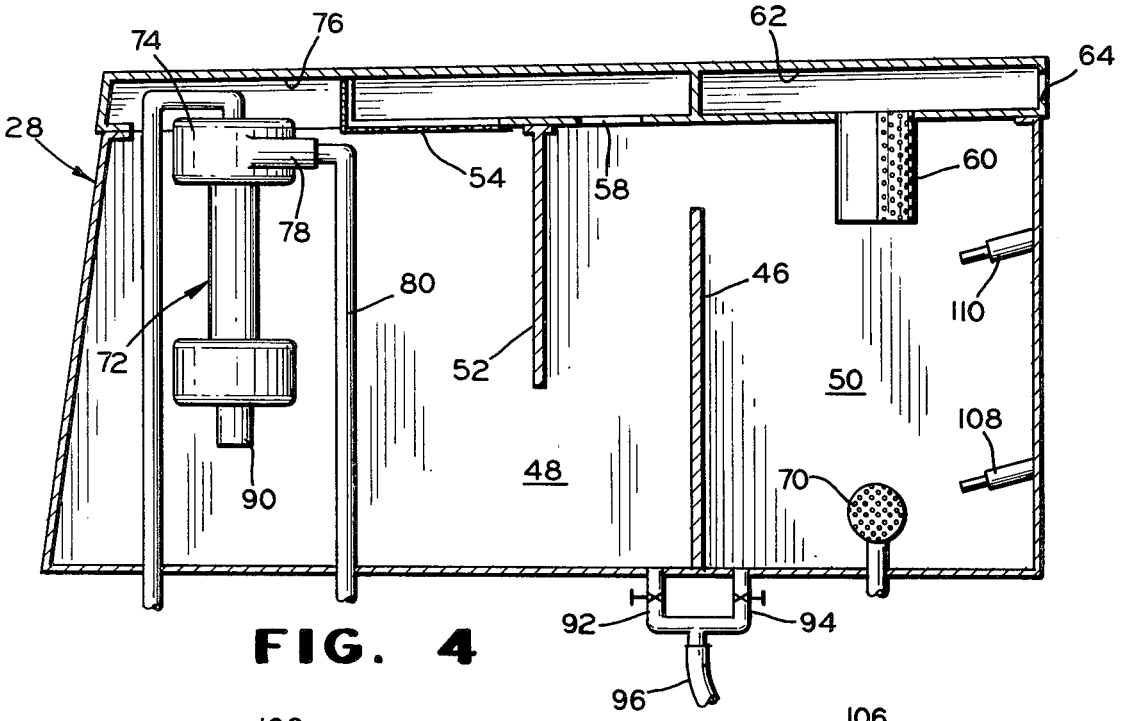
FIG. 4 is a somewhat schematic view in longitudinal cross section taken through the recovery tank.
Figure 5:
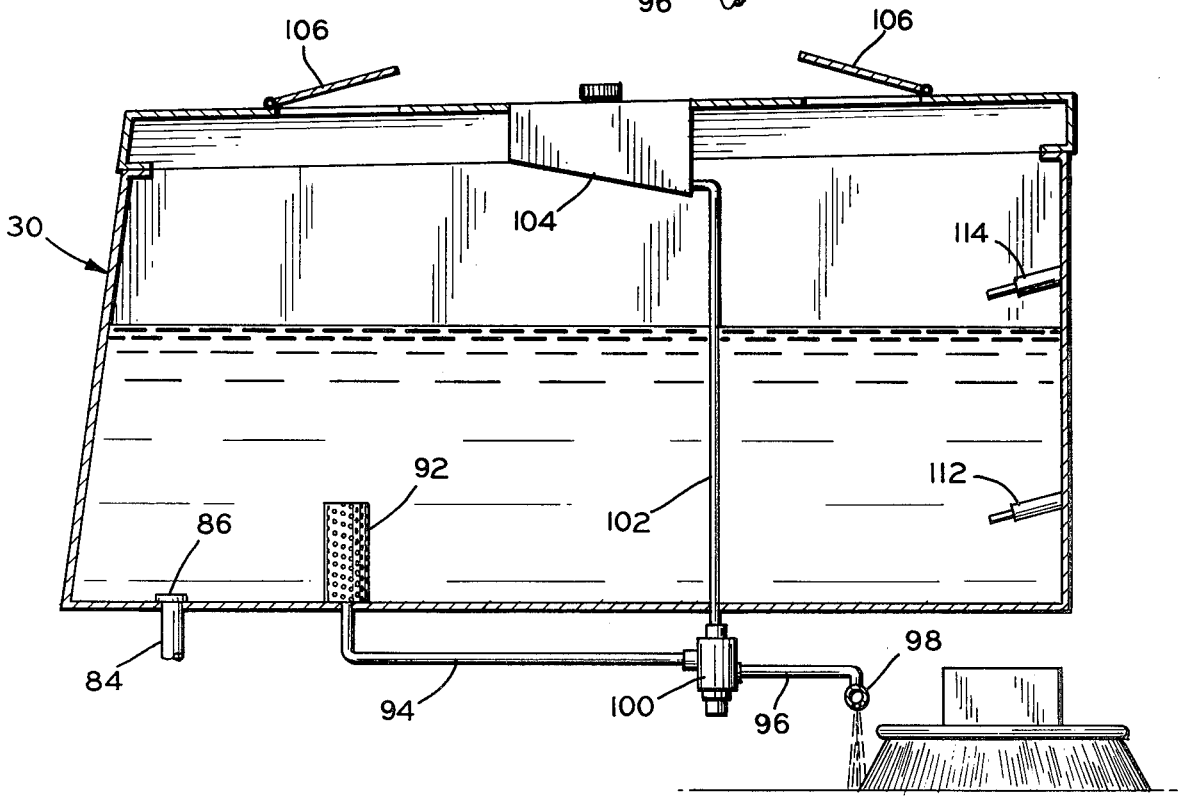
FIG. 5 is a somewhat schematic view in longitudinal cross section taken through the supply tank.

Dirt suspended in the solution in the first chamber 48 settles to the bottom of that chamber while cleaner solution flows over the upper edge of the dividing wall 46 and into the second chamber 50. When a pump 68 is operated, the cleaner solution in the chamber 50 is withdrawn through two outlet filters 70 and is supplied once again to the supply or solution tank 30. Preferably, this cleaner solution is not supplied directly to the supply tank but is passed through a commercially-available centrifugal separator 72. The separator removes a substantial portion of remaining suspended particles in the solution to render the solution more acceptable for cleaning once again. The separator has an enlarged upper portion 74 which extends upwardly into a recess 76 in the tank lid 38. The enlarged portion 74 has a tangential inlet 78 through which the solution is supplied through a line 80 communicating with the pump 68. A check valve 82 (FIG. 3) prevents reverse flow of the solution when the pump 68 is not operating. After particles are removed, primarily by centrifugal force, the liquid exits through a central line 84 which directs the cleaned liquid to the bottom of the supply tank 30 where it enters through an inlet opening 86 (FIGS. 3 and 5). A check valve 88 is also located in the line 84 to prevent reverse flow. Dirt collected in the separator 72 exits, along with controlled amount of liquid, through a drain orifice located in a discharge spout 90 at the bottom of the separator. This dirt collects in the bottom of the chamber 48 along with dirt settling out of the solution therein. When drain lines 92 and 94 (FIG. 4) connected with a flexible drain hose are opened, the recovery tank 28 can be emptied of the dirt and remaining solution. The recovery tank 28 can also be hinged to the machine frame and tilted outwardly and downwardly to dump solution and dirt collected therein.

The cleaned solution in the supply tank 30 flows by gravity through an outlet filter 92 in the bottom of the tank and through lines 94 and 96 to a manifold pipe 98 extending across the machine near the disc brushes 20. This pipe has lower openings through which the solution flows and is distributed on the surface near the disc brushes, producing a scrubbing action. If desired, a metering pump 100 is located between the lines 94 and 96 to supply metered quantities of detergent to the cleaned solution from a line 102 and a detergent supply tank 104 located in the top of the supply tank 30. The quantity of detergent metered can be controlled by the operator. Lids 106 can be located on either side of the detergent tank 104 to supply water to the supply tank 30 and for cleaning purposes, and for flushing the tank through a drain hose (not shown).

Lower and upper level sensors 108 and 110 are located in the recovery tank 28, and specifically in the chamber 50 thereof and lower and upper level sensors 112 and 114 are also located in the supply tank 30. The lower probe 108 in the recovery tank will turn the pump 68 off when the solution is low and the upper probe 110 will turn the pump on when the solution level is high. The lower probe 112 in the supply tank will turn on a driver's panel lamp when the solution is low and the upper probe 114 will turn on another driver's panel lamp when the solution is high. This probe will also turn off the pump 68 under that condition. The probe 114 is only activated when an excessive amount of water already on the surface being cleaned and not deposited by the machine is encountered and picked up.

At times, it is desired to operate the scrubbing machine 10 in the conventional manner without recirculation. This may occur, for example, for a very dirty surface which is then first cleaned with the machine operating in the conventional manner and subsequently cleaned with the machine operating with the machine operating with the recirculating feature. When the machine is operated in the conventional manner, the pump 68 is turned off. The supply tank 30 is then filled with water and with detergent mixed directly therein. The recovery tank 38 is then empty. When the machine is used in the recirculatory manner, the same amount of water is supplied to the supply tank 30 with the detergent then separately added to the detergent tank 104. The first chamber 48 of the recovery tank is also filled with water. By way of example, the supply tank has 100 gallons of water and five gallons of detergent and the first chamber 48 of the recovery tank 30 has 60 gallons of water. With recirculation, both the pumps 68 and 100 are operated.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A scrubbing machine comprising a frame, wheel means for supporting said frame on the ground, a scrubbing brush carried by said frame, liquid collecting means carried by said frame behind said brush, a recovery tank supported by said frame, a supply tank supported by said frame, a liquid pick-up line communicating with said liquid collecting means and with said recovery tank, exhaust means communicating with said recovery tank to exhaust air therefrom, and means for supplying liquid from said supply tank toward said scrubbing brush, the improvement comprising: baffle means in said recovery tank for directing air and liquid from said pick-up line in a non-linear path through said recovery tank to separate the air and liquid, a centrifugal extracting device in said recovery tank for separating liquid and dirt, with the dirt from said extracting device collected in the bottom of said recovery tank, powered means for supplying liquid and dirt in a lower portion of said recovery tank to said extracting device, and means for supplying cleaned liquid from said extracting device to said supply tank.

2. A scrubbing machine according to claim 1 characterized by a dividing wall dividing said recovery tank into a first chamber and a second chamber, said extracting device being in said first chamber, and said powered means for supplying liquid and dirt from said recovery tank to said extracting device includes a pump which supplies the liquid and dirt from said second chamber.

3. A scrubbing machine according to claim 2 characterized by said last-named supply means including a check valve between said pump and said extracting device to prevent flow of liquid from said extracting device toward said pump, and said means for supplying cleaned liquid from said extracting device to said supply tank including a check valve between said device and said supply tank to prevent flow of liquid from said supply tank toward said extracting device.

4. A scrubbing machine according to claim 2 characterized by a level sensing device in an upper portion of said supply tank for turning off said pump when the liquid level is high, a second level sensing device in an upper portion of said recovery tank for turning on said pump when the liquid level is high, and a third level sensing device in a lower portion of said recovery tank for turning said pump off when the liquid level is low.

5. A scrubbing machine according to claim 1 characterized by said supply tank having a separate detergent tank therein, and a metering pump for supplying predetermined quantities of detergent to the liquid supplied from said supply tank toward said scrubbing brush.

6. A scrubbing machine comprising a frame, wheel means for supporting said frame on the ground, a scrubbing brush carried by said frame, liquid collecting means carried by said frame behind said brush, a recovery tank supported by said frame, a supply tank supported by said frame, a liquid pick-up line communicating with said liquid collecting means and with said recovery tank, exhaust means communicating with said recovery tank to exhaust air therefrom, and means for supplying liquid from said supply tank toward said scrubbing brush, the improvement comprising: a lid on said recovery tank forming an inlet passage for supplying air and liquid from said pick-up line to one end portion of said recovery tank, a baffle in said recovery tank, means forming a chamber in said lid for supplying air and liquid out of said recovery tank, over said baffle, and back into said tank, means forming an air outlet at another end portion of said recovery tank spaced from said one end portion, said outlet means communicating with said exhaust means to direct air from said recovery tank through said exhaust means, and means for supplying cleaned solution from said recovery tank to said supply tank.

7. A scrubbing machine according to claim 6 characterized by a centrifugal extracting device located in said recovery tank, and said means for supplying cleaned liquid from said recovery tank to said supply tank supplies the liquid through said extracting device.

8. A scrubbing machine according to claim 7 characterized by said last-named supply means includes a pump upstream of said extracting device, a check valve between said pump and said extracting device to prevent flow of liquid from said extracting device toward said pump when said pump is not operating, and a second check valve between said extracting device and said supply tank for preventing flow of liquid from said supply tank toward said extracting device when said pump is not operating.

9. A scrubbing machine according to claim 7 characterized by said recovery tank having a dividing wall dividing said recovery tank into a first chamber and a second chamber, said extracting device being in said first chamber, and said means for supplying liquid and dirt from said recovery tank to said extracting device supplies the liquid and dirt from said second chamber.

10. A scrubbing machine according to claim 8 characterized by a level sensing device in an upper portion of said supply tank for turning off said pump when the liquid level is high, a second level sensing device in an upper portion of said recovery tank for turning on said pump when the liquid level is high, and a third level sensing device in a lower portion of said recovery tank for turning said pump off when the liquid level is low.

11. A scrubbing machine according to claim 6 characterized by said supply tank having a separate detergent tank therein, and metering pump for supplying predetermined quantities of detergent to the liquid supplied from said supply tank toward said scrubbing brush.

12. A scrubbing machine comprising a frame, wheel means for supporting said frame on the ground, a scrubbing brush carried by said frame, liquid collecting means carried by said frame behind said brush, a recovery tank supported by said frame, a supply tank supported by said frame, a pick-up hose communicating with said liquid collecting means and with said recovery tank, exhaust means communicating with said recovery tank to exhaust air therefrom, and means for supplying liquid from said supply tank toward said scrubbing brush, the improvement comprising a separating wall in said recovery tank and forming first and second chambers in said recovery tank, means in said recovery tank forming a tortuous path for air and dirty liquid drawn into said tank by said exhaust means through said pick-up hose with dirty liquid being separated from the air and collected mostly in said first chamber, with dirt therein settling to the bottom and with cleaner liquid flowing over the upper edge of said separating wall into said second chamber, pump means for supplying liquid from said second chamber to said supply tank, a centrifugal extracting device located in said first chamber, and said pump means supplies the liquid from said second chamber through said extracting device to said supply tank.

13. A scrubbing machine according to claim 12 characterized by a check valve between said pump means and said extracting device to prevent flow of liquid from said extracting device toward said pump means, and a check valve between said extracting device and said supply tank to prevent flow of liquid from said supply tank toward said extracting device.

14. A scrubbing machine comprising a frame, wheel means for supporting said frame on the ground, a scrubbing brush carried by said frame, liquid collecting means carried by said frame behind said brush, a recovery tank supported by said frame, a supply tank supported by said frame, a pick-up hose communicating with said liquid collecting means and with said recovery tank, exhaust means communicating with said recovery tank to exhaust air therefrom, and means for supplying liquid from said supply tank toward said scrubbing brush, the improvement comprising a separating wall in said recovery tank and forming first and second chambers in said recovery tank, means in said recovery tank forming a tortuous path for air and dirty liquid drawn into said tank by said exhaust means through said pick-up hose with dirty liquid being separated from the air and collected mostly in said first chamber, with dirt therein settling to the bottom and with cleaner liquid flowing over the upper edge of said separating wall into said second chamber, pump means for supplying liquid from said second chamber to said supply tank, said supply tank having a separate detergent tank therein, and a metering pump for supplying predetermined quantities of detergent to the liquid supplied from said supply tank toward said scrubbing brush.

15. In a scrubbing machine comprising a frame, wheel means for supporting said frame on the ground, a plurality of disc-type scrubbing brushes carried by said frame, a squeegee assembly carried by said frame behind said brushes, a recovery tank supported by said frame and having an inlet opening at one portion thereof, a liquid pick-up line communicating with said squeegee assembly and with said inlet opening of said recovery tank, exhaust means communicating with said recovery tank to draw air, liquid, and dirt from said squeegee assembly thrugh said pick-up line, said inlet, and into said recovery tank and for exhausting air from said recovery tank, a liquid supply tank supported by said frame, means for supplying liquid from said supply tank toward said disc-type scrubbing brushes, the improvement comprising a centrifugal extracting device in said recovery tank at the one portion thereof, line means connecting another portion of said recovery tank spaced from the one portion to said centrifugal extracting device and for connecting said centrifugal extracting device to said supply tank, and a pump separate from said extracting device for supplying liquid and dirt through said line means from said another portion of said tank to said centrifugal device and for supplying cleaned liquid through said line means from said extracting device to said supply tank.

16. A scrubbing machine according to claim 15 characterized by said pump being in said line means upstream of said centrifugal extracting device, and a check valve between said extracting device and said pump to prevent flow of liquid from said extracting device toward said pump.

17. A scrubbing machine according to claim 16 characterized by a second check valve in said line means between said extracting device and said supply tank to prevent flow of liquid from said supply tank toward said extracting device.

* * * * *